United States Patent [19]

Henderson et al.

[11] Patent Number: 4,671,354

[45] Date of Patent: Jun. 9, 1987

[54] WELL PACKER

[75] Inventors: William D. Henderson, Frisco; Dhirajlal C. Patel; Dennis D. Rood, both of Carrollton; Richard M. Sproul, Grapevine, all of Tex.

[73] Assignee: Otis Engineering Corporation, Dallas, Tex.

[21] Appl. No.: 770,149

[22] Filed: Aug. 27, 1985

[51] Int. Cl.[4] ..... E21B 33/128; E21B 33/129

[52] U.S. Cl. ..... 166/134; 166/140

[58] Field of Search ..... 166/134, 138, 139, 140, 166/216, 217

[56] References Cited

U.S. PATENT DOCUMENTS

| | | | |
|---|---|---|---|
| 3,746,093 | 7/1973 | Mullins | 166/217 |
| 4,296,806 | 10/1981 | Taylor et al. | 166/140 |
| 4,441,553 | 4/1984 | Setterberg, Jr. et al. | 166/140 |
| 4,444,252 | 4/1984 | Fisher, Jr. | 166/217 |
| 4,524,825 | 6/1985 | Fore | 166/140 |

*Primary Examiner*—Stephen J. Novosad
*Assistant Examiner*—William P. Neuder
*Attorney, Agent, or Firm*—H. Mathews Garland

[57] ABSTRACT

A well packer adapted to be set and reset in a well bore without removal of the packer from the well bore including a packer mandrel adapted to be connected with a tubing string, an interlocking segment assembly on the packer mandrel for releasable connection with the mandrel, a drag spring assembly connected with the interlocking segment assembly for frictional engagement with a well bore wall, a locking slip assembly coupled with the drag spring assembly for locking the packer with the well bore wall, a seal element package assembly connected with slip assembly for sealing around the packer mandrel with the well bore wall, and a detent ring between the slip assembly and the seal element package permitting initial setting of the upper ends of the slips and preloading of the seal element package preliminary to final setting of the slips and expansion of the seal element package.

14 Claims, 7 Drawing Figures

WELL PACKER

BACKGROUND OF THE INVENTION

1. Field of the Invention

This invention relates to well packers and more particularly to well packers which may be set and reset without retrieval in injection, production, and disposal well applications.

2. History of the Prior Art

It is well known in the well art and particularly in the oil and gas industry to use well packers in the bore of a well around the well tubing to seal the annulus between the well tubing and the well bore wall for isolating one or more vertical portions of the well bore. Well packers are used in testing, treating, and producing wells and in disposal well applications. These various and diverse systems employing well packers involve a wide range of depths at which the packers are used, environments which may produce extremes of high temperature and pressure as well as corrosive fluids, brine solutions, water, steam, and other natural formation fluids and fluids used in treating and producing wells. These various applications require a maximum of pressure sealing and corrosion resistance when left in place over long periods of time. In addition to the need for functioning in extreme hostile environments, the high cost of running, setting, and pulling packers in wells which requires handling equipment at the surface as well as substantial periods of shut-down time, make it highly desirable to use packers capable of release and reset within a well bore without removal. It is particularly desirable for such a packer to be simple in construction with a minimum number of parts utilizing such features as one piece locking slips, wherein one end of such slips is set initially before fully expanding and locking the slips. Further, it is desirable that such a packer be capable preloading or partially expanding the annular seal assembly prior to setting the slips to achieve maximum leak-free seals. Typical well packers having some features in common with the present invention, but, however, lacking the particular improvements of invention are shown in U.S. Pat. Nos. 3,467,184, 4,296,806, and 4,524,825.

SUMMARY OF THE INVENTION

It is a particularly important object of the invention to provide a new and improved well packer.

It is another object of the invention to provide a new and improved well packer useful in injection, production, and disposal well applications.

It is another object of the invention to provide a packer having an interlocking assembly for locking the packer in a set mode in response to a linear force only and releasing the packer by rotation.

It is another object of the invention to provide a short, compact, corrosion-resistant packer that can be set at any depth in a well bore.

It is another object of the invention to provide a packer having one-piece slips wherein the upper ends of the slips are initally set prior to full expansion of the slips.

It is another object of the invention to provide a well packer which is set with tension and may be left in tension, in neutral, or in compression.

It is another object of the invention to provide a packer which can be set and reset while retaining maximum capability of withstanding pressures.

It is another object of the invention to provide a well packer which may be released by application of a staight or longitudinal force if the tubing cannot be rotated.

It is another object of the invention to provide a well packer which withstands pressures from either direction across the packer.

It is another object of the invention to provide a well packer which includes a safety shear release feature.

It is another object of the invention to provide a packer having a seal element package which is preloaded prior to setting the locking slip of the packer.

It is another object of the invention to provide a well packer which maintains the setting force placed in the seal elements.

In accordance with the invention there is provided a well packer having a tubular body mandrel provided with a longitudinal central flow passage, a drag spring assembly on the body mandrel to engage the well bore wall permitting the mandrel to move rotationaly and longitudinally, an interlocking segment assembly between the drag spring assembly and the mandrel for locking the packer set and releasing the packer, a locking slip assembly on the body mandrel coupled with the drag spring assembly, an annular seal assembly on the body mandrel expandable responsive to longitudinal movement of the body mandrel, and a detent between the seal assembly and the locking assembly for initially setting one end of the locking slips and pre-loading the seal assembly before final setting of the slips.

BRIEF DESCRIPTION OF THE DRAWING

The foregoing objects and advantages of the invention together with the specific details of a preferred embodiment will be better understood from the following detailed description taken in conjunction with the accompanying drawings wherein.

DETAILED DESCRIPTION OF THE PREFERRED EMBODIMENT

Figure 1A:
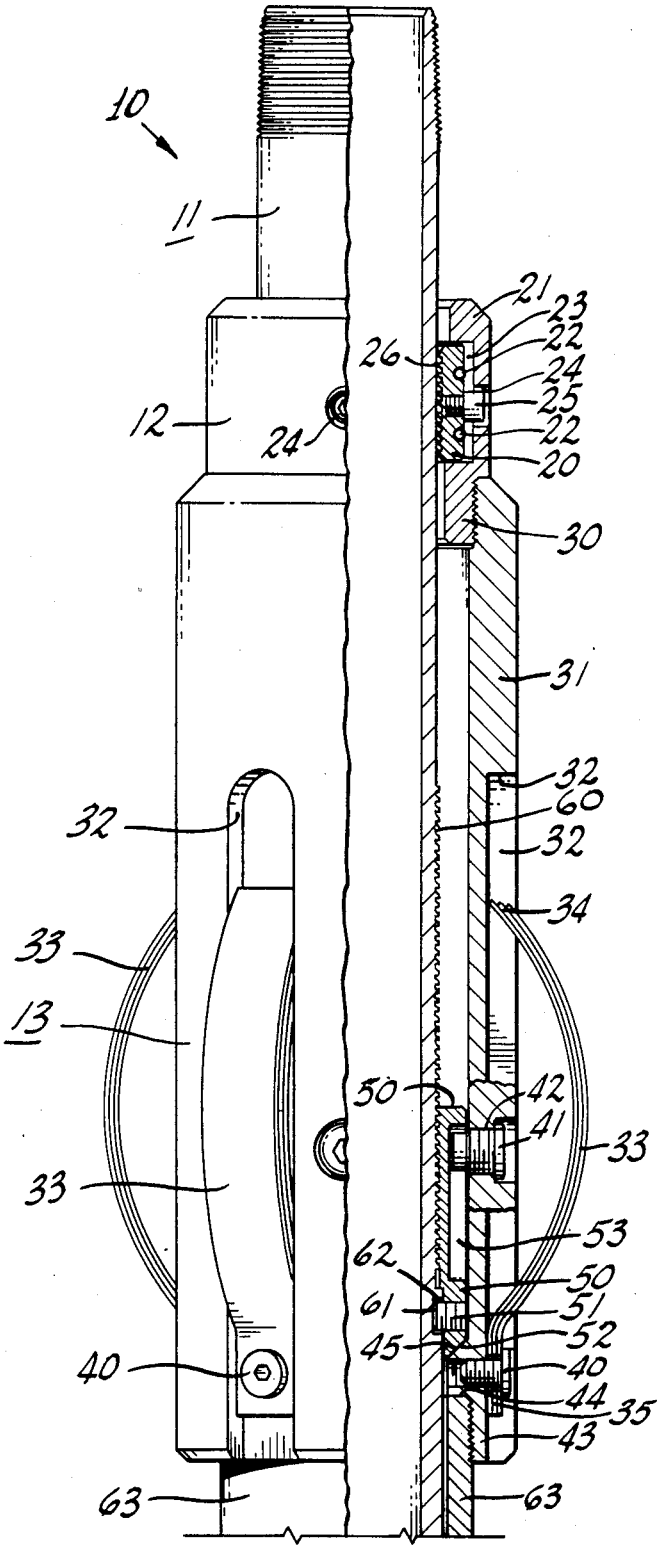
FIGS. 1A, 1B, and 1C taken together form a longitudinal view in section and elevation of the well packer of the invention in a running condition.

Referring to FIGS. 1A–1C and 2, a well packer 10 embodying the features of the invention includes a tubular mandrel 11 threaded at opposite ends for connection of the packer with pipe sections to form an integral part of a well tubing string. Supported on and interconnected along the mandrel 11 are an interlock assembly 12, a drag spring assembly 13, a locking slip assembly 14, and a seal element package 15. Frictional engagement of the drag spring assembly with the inner wall of a well casing permits rotation and longitudinal movement of the mandrel 11 relative to the drag spring assembly, the locking slip assembly, and the seal element package for expanding the seal element package and operating slips on the locking slip assembly to releasably lock the well packer at a desired depth in the well casing and expand the seal element package sufficiently to form a fluid tight seal around the packer mandrel with the well casing wall. The packer mandrel is initially rotated to release the mandrel for movement longitudinally and then pulled upwardly to initially preload the seal element package and thereafter expand the slip assembly to releasably lock the well packer in the casing. The interlock assembly 12 releasably locks the packer mandrel 11 to hold the slip assembly locked with the casing wall and the seal element package expanded between the casing wall and the packer mandrel. The packer mandrel may thereafter be rotated to release the mandrel from the interlocking assembly and again moved longitudinally to release the slip assembly and the seal element package for moving the packer to another location in the a well bore and resetting the packer. The slip assembly includes one piece slips the upper ends which are initially set and the seal element package is preloaded before setting the slips by use of a detent between the slip assembly and seal element package as described in detail hereinafter.

Referring to Fig 1A, the interlock assembly includes a plurality of circumferentially spaced interlocking segments 20 mounted within a housing head 21 and held in a radially expandable relationship around the mandrel 11 within the housing by garter springs 22. The housing 21 has an internal annular recess 23 defined between upper and lower shoulder surfaces to house the interlocking segments, limit the longitudinal movement of the segments, and permit the segments to move radially. A plurality of circumferentially spaced screw holes 24 are provided in the housing opening into the recess 23 for the heads of interlocking segment guide screws 25. One guide screw 25 is screwed into the center of each of the interlocking segments with the head of the guide screw fitting in loose relationship in a guide screw hole 24 so that the interlocking segment may move inwardly and outwardly with the guide screw holding the segment in proper position circumferentially within the recess. Each of the interlocking segments 20 is a circular segment extending less than 90 degrees around the annular recess 23 so that four of the segments are housed in the recess. Each of segments has longitudinally spaced recesses on opposite sides of the guide screw to receive the garter springs 22 so that two garter springs hold the segments around the mandrel while permitting the segments to expand and contract to perform locking and release functions with the mandrel. Each of the segments has internal thread portions 26 designed to engage threads on the mandrel, the mandrel threads and interlocking segment threads being shaped to permit ratchet action between the mandrel threads and the segment threads when the mandrel is pulled upwardly and to provide thread action when the mandrel is rotated to move the mandrel back downwardly. The head 21 has a slightly reduced externally threaded lower end section 30 which engages a tubular drag spring assembly housing 31.

As illustrated in FIG. 1A, the drag spring assembly 13 includes the housing 31 which has an internally threaded upper end section screwed on the lower end of the interlocking segment housing head 21. The housing 31 is provided with external downwardly opening circumferentially spaced longitudinal slots 32 each of which receives a drag spring 33. Each drag spring 33 is a laminated steel spring element outwardly bowed with a free upper end 34 and a flat lower end portion 35 provided with a screw hole for a screw 40 which threads into the housing 31 securing the lower end of the spring to the housing in the slot 32. The free upper end 34 of the spring is biased inwardly against the bottom of the slot 32 so that a radial inward force on the spring spreads the spring longitudinally as the spring drags along a casing wall so that the outward reaction force of the spring provides a friction holding action between the drag spring assembly and the casing wall. A sufficient number of springs of predetermined strength are used to provide the necessary drag to hold the housing against rotation and longitudinal movement while the mandrel 11 is manipulated in the housing for setting and releasing the packer. A plurality of inwardly projecting J-latch guide lugs 41 are mounted through the wall of the housing 31 spaced around the housing between the spring slots 32. It will be seen that each guide lug has a head portion fitting in an enlarged recessed portion of a threaeed hole 42, through the housing wall and a cylindrical smooth guide head projecting into the bore of the housing 31. The drag spring housing 31 has an internal threaded lower end portion 43 extending upwardly to an internal annular stop flange 44 provided with a tapered upper stop shoulder surface 45. The flange 44 performs a stop shoulder function as well as providing the housing 31 with substantial wall thickness for the screws 40 which secure the drag springs 33 to the housing.

Figure 2:
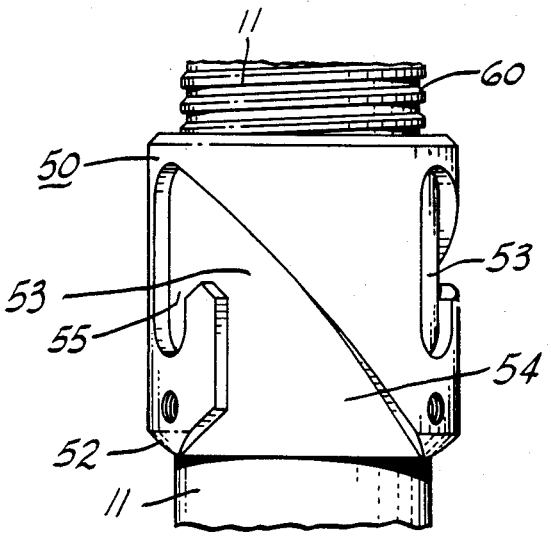
FIG. 2 is a fragmentary view in elevation of a portion of the packer mandrel showing a J-latch on the mandrel.

As illustrated in FIGS. 1A and 2, a J-latch 50 is mounted on the mandrel 11 within the housing 31 for coaction with the lugs 41 for releasably interconnecting the mandrel with the drag spring assembly while running the packer. The J-latch is an internally threaded tubular member threaded on the mandrel 11 and held by set screws 51 threaded through the J-latch against the mandrel surface. The lower end edge of the J-latch has a downwardly and inwardly tapered stop shoulder surface 52 which is engageable with the housing stop shoulder 45 limiting the downward movement of the mandrel 11 in the housing 31. The J-latch has circumferentially spaced external J-slots 53 which are conventional in design having divergent mouth portions 54 opening into shorter longitudinal locking portions 55. Each of the J-slots 53 is machined into the outer surface of the J-latch to a depth to receive the inward end of a J-latch lug 41 as seen in FIG. 1A. An equal number of lugs 41 and J-latch slots 53 are provided. When the mandrel 11 is rotated to a position at which the lugs 41 are in the mouth portions 54 of the J-latch slots the mandrel is free to move longitudinally upwardly. When the lugs are positioned in the J-latch locking portions 55, the mandrel 11 has limited longitudinal freedom. The mandrel 11 has external threads 60 extending a substantial length of the mandrel for securing the J-latch 50 on the mandrel and for co-acting with the interlocking elements 20 to lock the packer in set condition. The threads 60 extend substantially above the J-latch 50 and are designed to be compatable with the internal thread sections of the interlocking elements 20 to permit the mandrel to rotate downwardly relative to the elements as well as to ratchet upwardly through the elements. The mandrel 11 is provided with an external annular recess 61 below an annular stop shoulder 62 at the lower end of the threads 60 on the mandrel 11. The set screws 51 through the J-latch 50 engage the recess 61 when the J-latch has been screwed down until it engages the stop shoulder 62 on the mandrel.

Figure 1B:
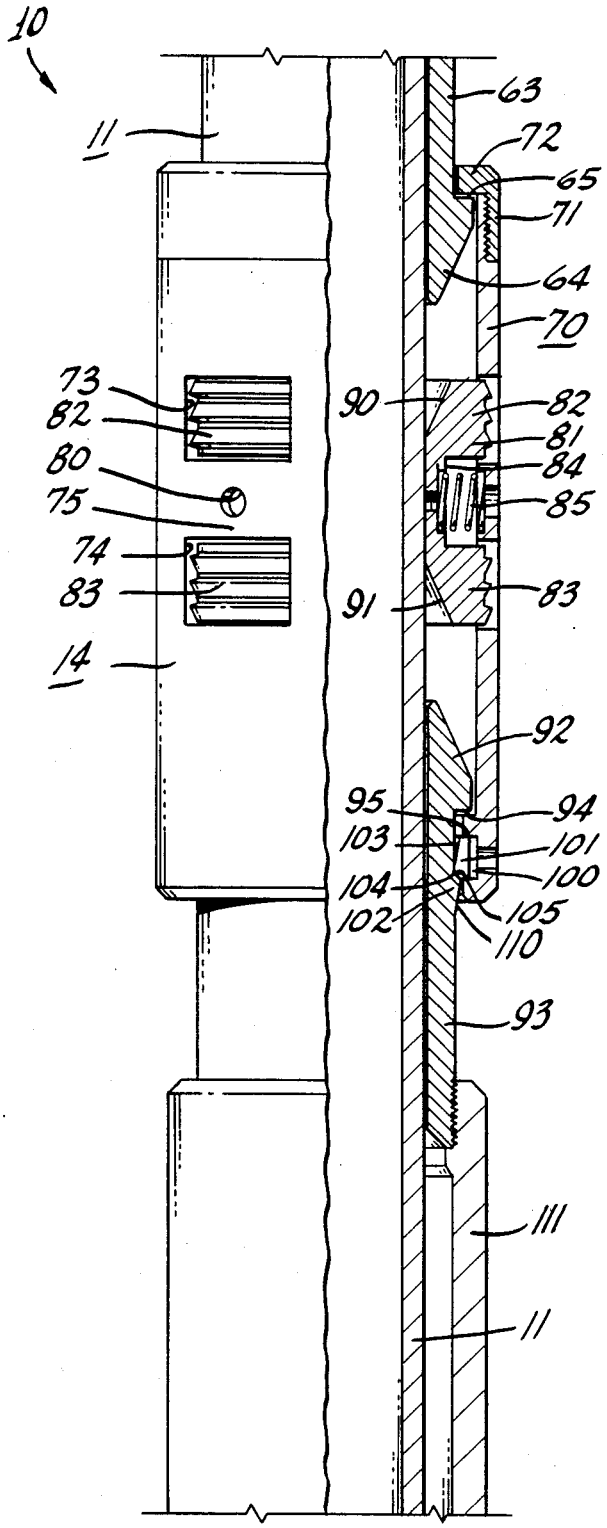

Referring to FIGS. 1A and 1B, the drag spring assembly 13 is coupled with the slip assembly 14 by a tubular member 63 which threads into the lower end of the housing 31 and is provided along a lower end portion with an upper slip expander 64. The upper end edge of the slip expander 64 defines an external annular shoulder 65. The slip assembly 14 includes a tubular slip carrier 70 fitted in concentric spaced relation around the mandrel 11. A retainer cap 71 is threaded on the upper end of the slip carrier 70 and has an internal annular end flange 72 engageable by the external annular shoulder surface 65 on the slip expander 64 coupling the slip assembly 14 with the drag spring assembly 13. The slip carrier 70 has circumferentially spaced pairs of slip windows 73 and 74 above and below a transverse slip retainer portion 75 of the carrier 70, each of which is provided with a hole 80. A slip 81 having upper and lower toothed sections 82 and 83 is positioned in the carrier 70 behind each pair of slip windows 73 and 74. Each slip fits in the annular space around the mandrel 11 within the carrier 70. Each of the slips has a central transverse slot 84 which is wider than the retainer strip portions 75 of the carrier 70 so that the slips may move outwardly for expanding the toothed slip sections 82 and 83 into locking relationship outwardly of the outer wall of the carrier 70. A spring 85 is fitted in the slip slot 84 between each slip and the inside face of the slip carrier 70 around the hole 80 biasing each slip inwardly against the outer face of the mandrel 11 to release or unlocked positions as shown in FIG. 1B. As evident in FIG. 1B the toothed upper and lower portions of the slips are within the windows 73 and 74, respectively when the slips are fully retracted so that when the slip carrier is moved relative to the mandrel the slips are dragged along the mandrel with the carrier. The slips include tapered upper internal expander surfaces 90 and lower expander surfaces 91. The slip assembly 14 also includes a lower slip expander 92 formed on a tubular connector 93 by which the slip assembly is coupled with the seal element package 15. The lower outer end edge of the lower expander 92 defines an external annular downwardly facing stop shoulder 94 which is engageable with an internal annular stop flange 95 formed within the slip carrier 70 for holding the slip expander 92 in the lower end portion of the carrier 70. The lower end portion of the carrier 70 is provided with an internal annular latch ring recess 100 below the internal annular flange 95. A split detent ring 101 is disposed within the recess 100 to co-act with an external annular cam or detent boss 102 on the connecter 93. The detent ring 101 has an upwardly and outwardly sloping internal release cam surface 103 and a downwardly and outwardly more steeply angled locking cam surface 104. Similarly, the annular detent boss 102 around the connecter 93 has an upper steep locking cam surface 105 which slopes upwardly and inwardly and a much more gradual lower downwardly and inwardly sloping release cam surface 110. The co-action between the detent boss 102 and the latch ring 101 requires substantially more force to move the connecter 93 upwardly expanding the detent ring 101 outwardly during the setting of the packer than is required to move the slip carrier 70 back downwardly when releasing the packer and re-engaging the detent ring 101.

Figure 1C:
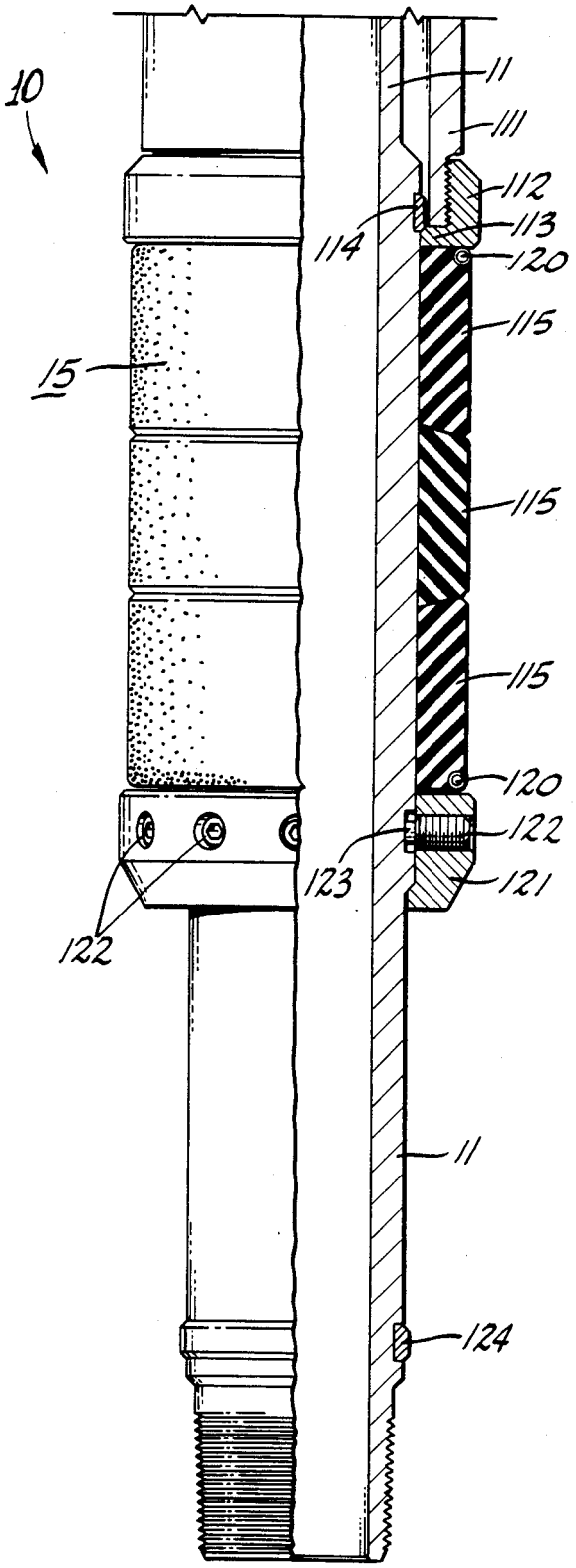

As shown in Figs 1B and 1C, a connecter 111 is threaded along an upper end portion on the lower end of the connecter 93 and along a lower end portion into a retainer cap 112 at the upper end of the seal element package 15. The cap 112 has an internal annular flange portion 113 which is engagable with a stop ring 114 secured around the mandrel 11 limiting the upward movement of the upper end of the seal element package on the mandrel. The seal element package comprises annular packer elements 115 of elastomeric construction which may include combinations of suitable metalic and non-metalic materials capable of withstand high pressures as well as corrosive fluids including CO2 and H2S. The upper and lower packer elements have embedded springs 120 to aid in resisting extrusion of the packer element material when expanded in sealed relationship against a casing wall. A lower annular retainer 121 is secured on the mandrel 11 by circumferentially spaced safety shear pins 122 which screw through the retainer 121 with the inward ends of the shear pins fitting in an external annular recess 123 formed around the mandrel 11. A stop ring 124 is secured around the mandrel 11 spaced below the retainer 121 for holding the packer structure on the mandrel if it is necessary to shear the shear pins for emergency release of the packer as explained in more detail hereinafter.

Figure 3A:
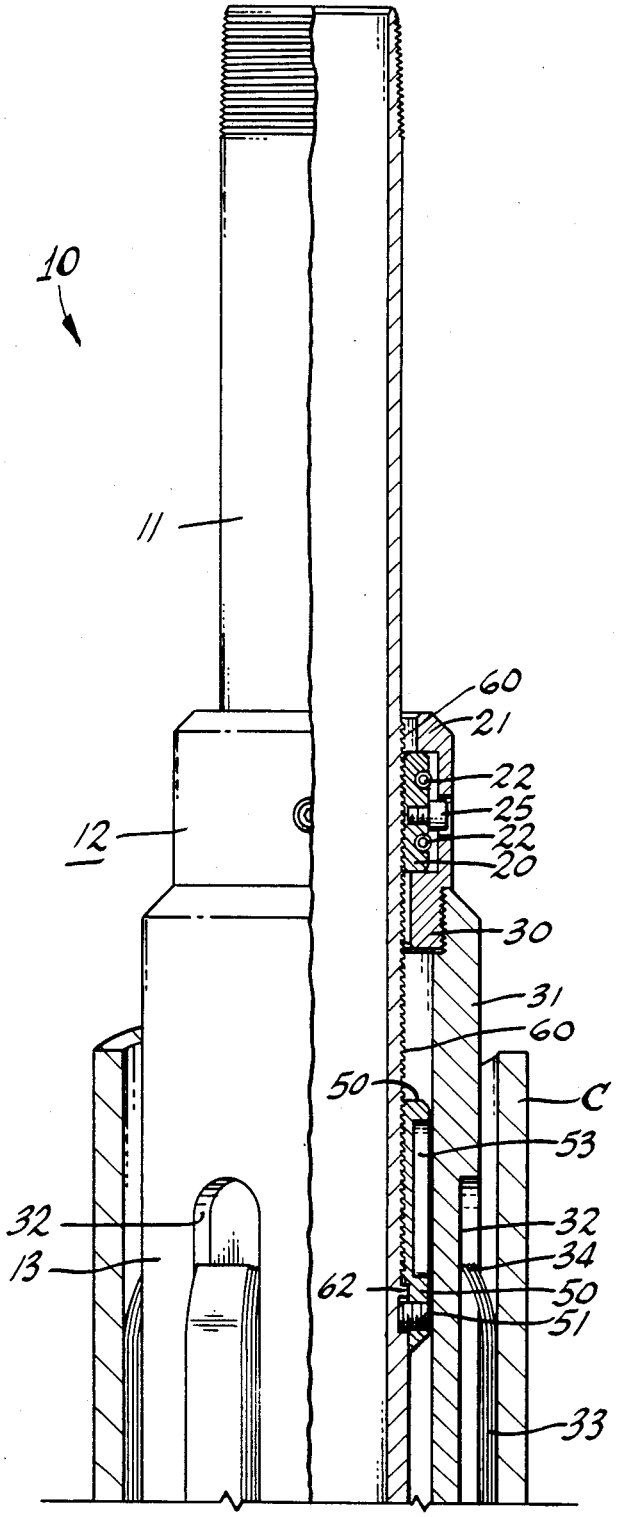
FIGS. 3A, 3B, and 3C taken together form a longitudinal view in section and elevation of the packer set in the casing of a well bore.
Figure 3B:
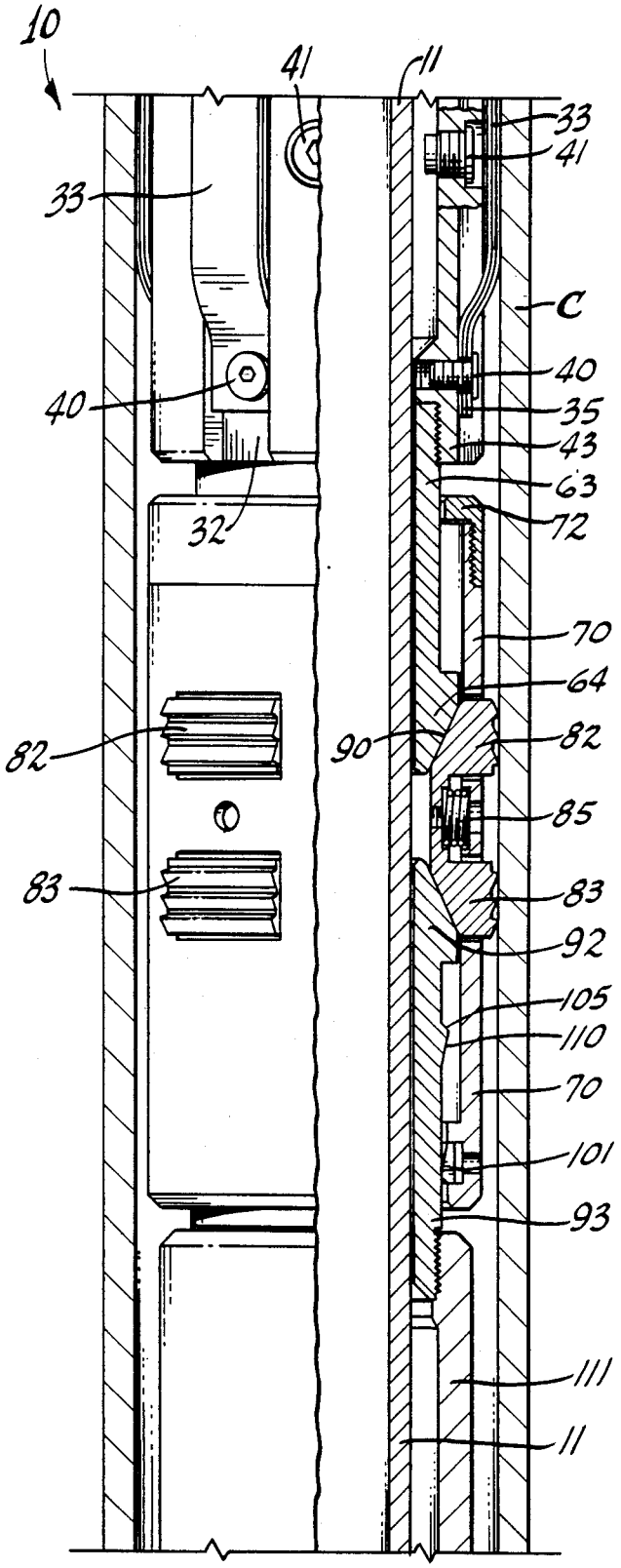
Figure 3C:
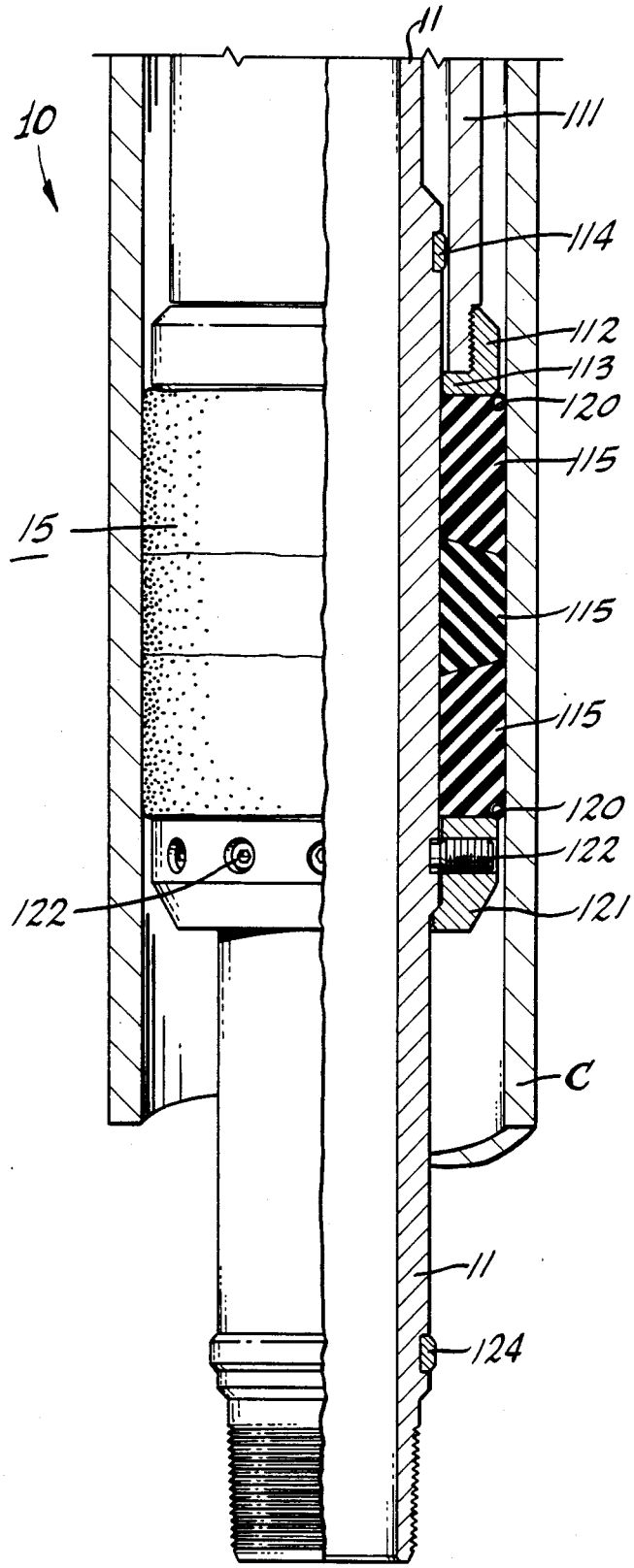

When the well packer 10 of the invention is to be run and set in a well bore, the packer is connected in a tubing string, not shown. The packer may be an integral part of the tubing string with sections of pipe above and below the packer. The packer also may be connected to the lower end of the string. The packer is secured in the tubing string by connection of the pipe sections making up the tubing string to the threaded upper and lower ends of the packer mandrel 11. The packer is lowered in the well bore by the tubing string in the condition represented in FIGS. 1A–1C. The elements 115 of the seal element package 15 are fully collapsed. The locking slips 81 of the slip assembly 14 are fully retracted as illustrated in FIG. 1B. The drag spring assembly 13 is latched to the mandrel 11 by engagement of the lugs 41 in the J-latch slots 55 of the J-latch 50 so that as the packer is lowered the drag spring assembly does not shift longitudinally on the packer mandrel as the springs 33 drag along the wall of the well bore casing C as seen in FIGS. 3A–3B. The upward drag of the springs along the casing wall will, however, tend to hold the latch spring assembly at an upper position on the mandrel at which the lugs 41 are at the upper ends of the J-latch slot portions 55 as shown in FIG. 1A. When the packer is at the desired depth in the well bore the tubing string is rotated clockwise as viewed from the upper end of the tubing string at the well head so that the packer mandrel is turned positioning the J-latch lugs 41 in the mouth portions 54 of the J-latch slots. The drag of the springs 33 against the casing wall resist rotation by the drag spring assembly whereby the turning of the mandrel 11 causes relative motion between the mandrel including the J-latch 50 moving the J-latch 50 to the release position. The downward angular slope of the upper edges of the mouth portion 54 of the J-latch slots cams the packer mandrel to a position in which the J-latch lugs 41 move out of the J-latch slots and the tubing string with the packer mandrel may be lifted upwardly for tension setting of the packer. As the tubing string and the packer mandrel 11 are pulled upwardly the drag springs 33 continue the frictional engagement with the casing C thus resisting upward movement by the drag spring assembly. The slip assembly 14 and the seal element package 15 are coupled with the drag spring assembly while the mandrel 11 is sheared pinned only to the bottom retainer ring 121 of the seal element package. The upward movement of the packer mandrel 11 thus lifts the seal element package, the tubular connecter 111 secured to the upper end of the seal element package, the connecter 93, and applies an upward force to the detent ring 101 through the surfaces 105 on the connecter 93 and 104 in the detent ring. The upward force on the detent ring 101 lifts the entire locking slip assembly 14 relative to the expander 64 connected with the lower end of the drag spring assembly 13 which resists upward movement. The seal element package 15 with the connecters 111 and 93 and the slip carrier 70 and slips 81 thus move upwardly simultaneously toward the upper expander 64. When the upper expander surfaces 90 of the slips 81 engage the tapered surfaces of the upper expander 64 the upper ends of the slips 81 are cammed radially outwardly in the windows 73 of the slip carrier 70. The latch ring 101 keeps the lower expander 92 latched with the slip carrier 70 at the position shown in FIG. 1B until the upper ends of the slips are cammed outwardly by the upper slip expander with the upper toothed section 82 of the slips engaging the casing wall. When the upper ends of the slips initially engage the casing wall and are firmly wedged between the casing wall and the expander 64, continued upward force from the mandrel 11 through the detent ring 101 is resisted by the now immobile slip carrier 70 until release of the detent ring. With the continued upward movement of the seal element package with the couplers 111 and 93 resisted by the detent ring, further upward force through the tubing string on the packer mandrel moves the packer mandrel upwardly within the seal elements 115 because of the connection between the packer mandrel and the lower seal element retainer ring 121 through the shear pins 122. Radial expansion of the seal elements is initiated by the upward force of the retainer ring 121 against the lower end of the bottom seal element 115 thus preloading the seal element package prior to complete setting of the locking slips 81. When the upward force on the packer mandrel and seal element package exceeds the holding ability of the detent ring 101, the detent ring is cammed radially outwardly by the cam surface 105 expanding the detent ring farther outwardly in the recess 100 releasing the ring from the connecter 93 of which the lower slip expander is an integral part. The steep angle of the cam surfaces 104 on the detent ring and 105 on the connecter 93 requires substantial pull on the packer mandrel to release the detent ring for expanding the lower ends of the slips. Continued upward force on the packer mandrel 11 lifts the preloaded seal element package with the connecters 111 and 93 upwardly so that lower slip expander 92 moves underneath the lower ends of the slips 81 engaging the lower slip expander surfaces 91 camming the lower ends of the slips outwardly fully setting the slips against the casing wall. Continued upward force through the tubing string on the packer mandrel lifts the seal element package fully expanding the seal elements 115 between the packer mandrel and the casing wall effectivly sealing the annulus between the mandrel and the casing C around the packer. During the several steps of setting the packer, as the packer mandrel 11 is pulled upwardly, the threads 60 along the packer mandrel are lifted within the interlocking segments 20 which are permitted to expand outwardly by the retaining springs 22 so that the packer mandrel rachets upwardly through the interlocking segments until the packer is fully set. The thread portions within the inwardly biased interlocking segments 20 engage the threads 60 on the packer mandrel locking the mandrel at the position illustrated in FIGS. 3A–3C. Because the interlocking segments 20 are captured in the head 21, the segments 20 cannot move longitudinally and thus the packer mandrel is locked in the upper end position illustrated with the slips 81 fully engaged with the casing C and the seal element package fully expanded in sealing relationship with the casing wall.

During the setting of the packer 10 as described, the upper ends of the slips 81 are initially engaged with the casing wall as the slips are expanded providing more effective contact between the slips and the casing wall when the lower ends of the slips are thereafter expanded. The slips hold the packer against both upward and downward forces and thus the packer will resist a pressure diferential in either direction across the seal element package and the tubing string may be left in tension, placed in compression, or supported in a neutral condition. The packer will remain set regardless of the direction a pressure differential is applied and the condition under which tubing string is left.

In accordance with the invention, the packer 10 is releasable for resetting the packer at another depth in the well bore without retrieval. In setting the packer, minimum longitudinal movement is involved for expanding the slips and the seal element package.

The packer is released for pulling or resetting by rotating the tubing string clockwise as viewed from above so that the threads 60 on the packer mandrel 11 thread downwardly through the interlocking segments 20 until the threads 60 are below and out of the segments. When the threads 60 are fully disengaged from the segments, the packer mandrel 11 is once again free to move relative to the drag spring assembly which resists rotation and longitudinal movement. During the downward threading of the packer mandrel, the seal element package 15 is extended and allowed to relax due to the downward movement of the lower retainer ring 121 until the ring 114 at the upper end of the seal element package engages the upper retainer ring 114 on the seal element package. Continued downward movement of the mandrel 114 then pulls the connecters 111 and 93 downwardly removing the lower expander 92 from under this slips 81 so that the slips begin to relax, and when the lower slip expander 92 is at the lower end position of FIG. 1B, the shoulder 94 on the expander reengages the flange 95 in the slip carrier 70 so that the slips 81 are pulled downwardly from the upper slip expander 64 to permit the slips to move fully inwardly due to the force of the springs 85. The gradual angle of the surface 103 in the detent ring 101 permits the detent ring to relatch with a relatively low downward force applied through the packer mandrel. Also, as the packer mandrel moves back downwardly the relative movement between the packer mandrel and the drag spring assembly causes the J-latch lugs 41 to move back into the J-latch slots 53. The wide open mouths of the 54 of the J-latch slots insures that the lugs 41 enter the slots with continued downward movement of the packer mandrel and the camming effect of the upper edges of the slots moving the mandrel to a relative position at which the lugs 41 are in the upper end portions of the J-latch slots. Rotation of the tubing string and packer mandrel back counter clockwise insures that the J-latch 50 rotates relative to drag spring lugs 41 which are held against rotation by the springs 33 so that the lugs 41 are in the vertical locking portions 55 of the J-latch slots relocking the packer mandrel with drag spring assembly so that the drag spring assembly is moved upwardly or downwardly with the packer mandrel for resetting or moving the packer. In this mode for resetting or removal, all of the parts of the packer are back at the positions represented in FIGS. 1A–1C. For resetting the packer, the previously described procedure is again carried out to expand the slip assembly 14 and the seal element package 15 at a different depth in the well bore.

If a condition develops which prevents rotation of the tubing string, the packer may be released to retrieve the packer from the well bore by an upward force on the tubing string. Such upward force applied to the fully set packer causes the packer mandrel to rachet farther upwardly in the interlocking segments 20 and the shear force applied by the mandrel to the inward ends 123 of the shear pins 122 shears the pins releasing the bottom retainer ring 121 of the seal element package 15 from connection with the mandrel. The ring 121 drops downwardly on the reduced diameter portion of the packer mandrel and is prevented from falling off of the packer mandrel by the bottom ring 124. The seal element package relaxes contracting inwardly and the seal element package along with the couplers 111 and 93 are free to move downwardly removing the upward force on the lower slip expander 92. Continued upward force on the packer mandrel will lift the drag spring assembly along with the upper slip expander 64 fully releasing the slips so that the packer may be retrieved from the well bore. Of course the packer will then will have to be fully retrieved from the well bore because of the shearing of the pins 122. The packer cannot be reset in the well. This procedure of removal of the packer would be used under emergency conditions only.

It will now be seen that a new and improved well packer has been described and illustrated. The packer includes a minimum number of parts which reduces the cost of manufacture and packer maintenance and service. In accordance with the particular features of the invention, the packer may be set and reset in a well without removal. The upper ends of the one piece slips are set first maximizing the setting of the slips. The packer is locked in set condition by an interlocking segment assembly requiring only a linear tension force and is released by rotation.

What is claimed is:

1. A well packer comprising:

a tubular body mandrel having a central longitudinal flow passage;

a drag spring assembly mounted on said body mandrel for engaging a well bore wall to hold said drag spring assembly for relative rotational and longitudinal movement of said body mandrel therein;

a locking assembly including longitudinally spaced slip expanders and expandable slips in a slip carrier arranged for movement of said slips and said slip carrier as a unit mounted on said body mandrel coupled with said drag spring assembly for releasably locking said packer with said well bore wall;

an annular seal element package mounted on said body mandrel coupled with said slip assembly for sealing between said body mandrel and said well bore wall; and detent means between said seal assembly and said slip carrier of said locking assembly releasably coupling said slip carrier with the seal assembly for advancing said slip carrier with said slips for initially setting the advancing end of said slips by engagement with a first of said slip expanders and preloading said seal element package prior to final setting of said slips.

2. A well packer in accordance with claim 1 wherein said detent means is resetable for repeatedly setting, releasing, and resetting said packer in a well bore without removal of said packer from said well bore.

3. A well packer in accordance with claim 2 including a releasable interlocking assembly between said drag spring assembly and said body mandrel for holding said packer locked in said well bore and repeatedly releasing and resetting said packer in said well bore.

4. A well packer in accordance with claim 3 including a coupling assembly between said mandrel and said drag spring assembly for releasably connecting said mandrel with said drag spring assembly when said packer is in a release condition.

5. A well packer in accordance with claim 4 including a connecter means between said mandrel and said seal element package for emergency release of said packer from a well bore.

6. A well packer in accordance with claim 2 wherein said detent means comprises a split detent ring having first and second cam surfaces, said first cam surface being at a higher angle than said second cam surface, said first cam surface functioning to hold one end of said seal element package for preloading said package during setting said packer, and said second cam surface effecting relatching of said ring during releasing of said packer.

7. A well packer in accordance with claim 6 where said locking assembly includes one piece locking slips having upper and lower toothed locking surfaces, said slip carrier holding said slips around said packer mandrel, said slip carrier being longitudinally movable relative to said drag spring assembly, an upper slip expander connected with said drag spring assembly for engaging upper ends of said slips, and a lower slip expander for engaging the lower ends of said slips, said lower slip expander being releasably coupled by said detent ring with said slip carrier.

8. A well packer in accordance with claim 7 including means for releasably locking said mandrel relative to said drag spring assembly for holding said packer set comprising a plurality of inwardly biased interlocking segments connected with said drag spring assembly, said segments being biased inwardly around said packer mandrel and adapted for radially expansion, said segments having internal thread portions, and said mandrel having external threads, said interlocking segment thread portions and said mandrel threads being configured to permit said mandrel to rachet upwardly in said segments and to hold said mandrel against downward movement, said mandrel threads being releasable from said interlocking segments by rotation of said mandrel therein.

9. A well packer in accordance with claim 8 including means for releasably coupling said drag spring assembly with said packer mandrel for moving said drag spring assembly with said mandrel and for uncoupling said mandrel from said drag spring assembly, said assembly comprising a J-latch on said mandrel having a J-slot means in the outer surface thereof and lug means in said drag spring assembly engagable in said J-slot means for coupling said drag spring assembly with said mandrel and disengagable from said J-slot means to release said mandrel from said drag spring assembly.

10. A well packer for running on a tubing string in a well bore adapted to be set and reset without retrieval from said well bore comprising:

a tubular body mandrel having a longitudinal bore therethrough and means for securing said mandrel with a tubing string;

an annular seal element package on said mandrel;

a lower retainer ring on said mandrel below said seal element package for urging the lower end of said seal element package upwardly toward the upper end thereof for expanding said package on said mandrel;

a upper retainer ring at the upper end of said seal element package for holding the upper end of said seal element package during the expansion thereof;

a stop ring on said mandrel above said upper retainer ring to limit the upward movement of said retainer ring on said mandrel;

a lower tubular connecter secured with said upper retainer ring in concentric spaced relation around said mandrel;

a tubular locking slip carrier in concentric spaced relation around said mandrel having a lower end telescoping over an upper end of said tubular connecter;

said slip carrier having a plurality of circumferentially spaced locking slip windows;

a plurality of locking slips mounted around said mandrel in said slip carrier, each of said slips being behind and extendable through one of said retainer windows;

spring means between said slip carrier and each of said slips biasing said slips inwardly to release positions;

a lower slip expander in said slip carrier secured on said lower connecter;

a detent ring in the lower end of said slip carrier, said detent ring having internal cam surfaces for expanding said detent ring during the setting of said packer and the release of said packer;

said lower connecter having annular latch and cam surfaces thereon engagable with said detent ring for expanding said detent ring responsive to a first upward force applied during the setting of said packer and a second lower downward release force during the release of said packer from said well bore wall, said detent ring permitting preloading said seal element package and initial expansion of the upper ends of said slips during the setting of said packer;

an upper slip expander around said mandrel in the upper end of said slip carrier for engaging upper surfaces on said slips to expand said upper ends of said slips;

an upper connecter secured with said upper slip expander;

a drag spring assembly housing in concentric spaced relation around said mandrel secured along a lower end with said upper connecter;

a plurality of longitudinally extending drag springs secured in circumferential spaced relation to said housing for frictional engagement with said well bore wall to restrain said housing for longitudinal movement of said packer mandrel therein during the setting and release of said packer;

a plurality of J-latch lugs secured circumferentially spaced around and through the wall of said housing, said lugs having inward ends projecting into the bore through said housing around said packer mandrel;

a J-latch secured on said packer mandrel within said drag spring housing, said J-latch having a plurality of outwardly opening J-slots engagable by said lugs for coupling said mandrel with said drag spring housing at first positions of said J-latch relative to said lugs and for release of said J-latch from said housing at second positions of said J-latch relative to said lugs;

a tubular interlock head secured on the upper end of said drag spring housing around said packer mandrel, said housing having an internal annular recess therein;

a plurality of circumferentially spaced interlock segments around said packer mandrel in said internal recess of said head;

garter spring means around said interlock segments biasing said segments against the outer surface of said packer mandrel;

said interlock segments having internal thread portions and said packer mandrel having an externally threaded section along the outer surface of said mandrel above said J-latch, said threads along said mandrel and said threads sections in said interlock segments being configured to permit said packer mandrel to rachet upwardly through said interlock segments when said mandrel is pulled upwardly relative to said drag spring housing, to co-engage for locking said mandrel at an upper packer-set position, and to permit release of said packer mandrel from said interlock segments responsive to rotation of said mandrel downwardly in said segments for shifting said packer from a set condition to a release condition.

11. A well packer in accordance with claim 10 wherein said detent ring is positioned to restrain said lower expander from upward movement responsive to an upward force on said lower connecter until said seal element package is preloaded and said upward force on said lower connecter has lifted said slip retainer upwardly engaging said slips with said upper slip expander to expand the upper ends of said slips before the lower ends of said slips are expanded and said seal element package is fully longitudinally compressed.

12. A well packer in accordance with claim 11 including shear pins connected between said lower retainer ring below said seal element package and said packer mandrel for emergency release of said packer responsive to only upward force on said packer mandrel.

13. A well packer in accordance with claim 12 wherein each of said slips is a one piece member.

14. A well packer for running on a tubing string in a well bore adapted to be set and reset without retrieval from said well comprising:

a tubular body mandrel having a longitudinal bore therethrough and means for securing said mandrel with a tubing string;

an interlock assembly on said body mandrel adapted to lock said mandrel at an upper packer-set position responsive to an upward tension on said body mandrel and releasable for moving said packer in said well bore and retrieval of said packer by rotating said body mandrel downwardly in said interlock assembly;

a drag spring assembly on said mandrel connected with said interlock assembly for frictionally engaging the wall said well bore to restrain said drag spring assembly during the setting and release of said packer;

a J-latch assembly between said drag spring assembly and said body mandrel for releasably coupling said body mandrel with said drag spring assembly during running, releasing, relocating, and retrieval of said packer;

a slip assembly including a slip carrier on said body mandrel coupled with said drag spring assembly for releasably locking said well packer in said well bore;

a seal element package on said body mandrel to seal between said body mandrel and the wall of said well bore;

a detent assembly on said body mandrel for releasably coupling said seal element package with said slip carrier; and said detent assembly and said slip assembly being configured to preload said seal element assembly and expand upper ends of the slips on said slip assembly prior to expanding the lower ends of said slips and fully expanding said seal element assembly.

* * * * *